United States Patent [19]

Spercel

[11] 4,353,280

[45] Oct. 12, 1982

[54] TUNING DEVICE

[76] Inventor: Robert J. Spercel, 3214 W. 139, Cleveland, Ohio 44111

[21] Appl. No.: 867,133

[22] Filed: Jan. 5, 1978

[51] Int. Cl.[3] ..... G10D 3/14

[52] U.S. Cl. ..... 84/306; 29/437; 29/517

[58] Field of Search ..... 84/304, 305, 306, 202–204; 29/437, 517

[56] References Cited

U.S. PATENT DOCUMENTS

| | | | |
|---|---|---|---|
| 2,583,478 | 1/1952 | Finder | 84/305 |
| 3,240,098 | 3/1966 | Hepler | 84/306 |
| 3,431,807 | 3/1969 | Thompson | 84/306 |

*Primary Examiner*—Lawrence R. Franklin
*Attorney, Agent, or Firm*—Yount & Tarolli

[57] ABSTRACT

An improved device for tuning a string of a musical instrument includes a rotatable shaft having one end connected with the string. A pinion gear is connected with the opposite end of the shaft and is disposed in meshing engagement with a worm. The worm is rotatable about its central axis to effect rotation of the pinion gear and shaft with a resulting loosening or tightening of the string. The shaft is held against axial motion by deforming a portion of a housing into an annular groove in the shaft. The shaft is held against sidewise movement by engagement of a cylindrical surface area of the housing with the outside of the shaft.

25 Claims, 8 Drawing Figures

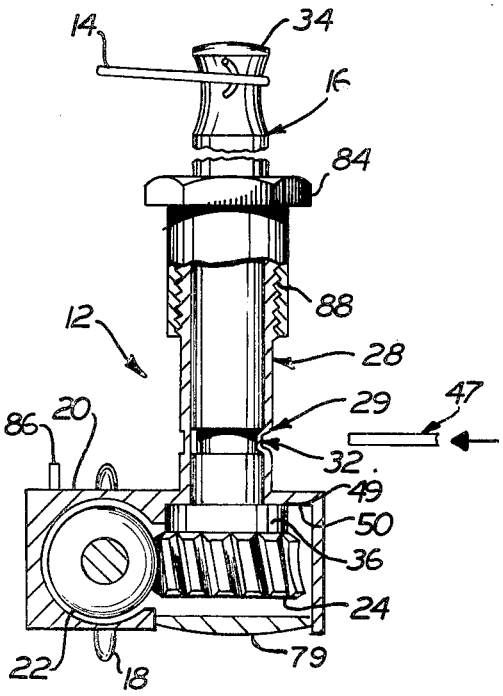
FIG.3
FIG.4
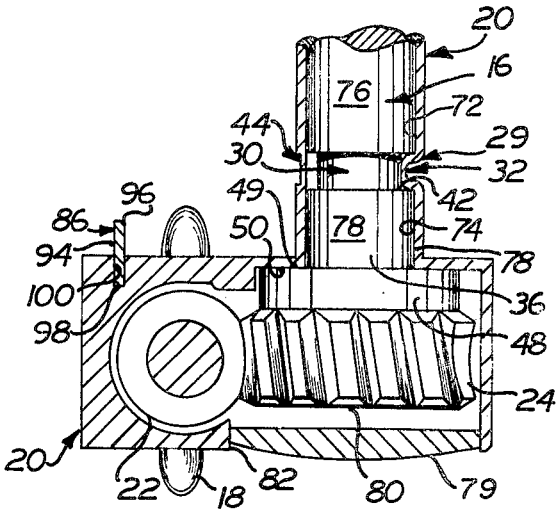
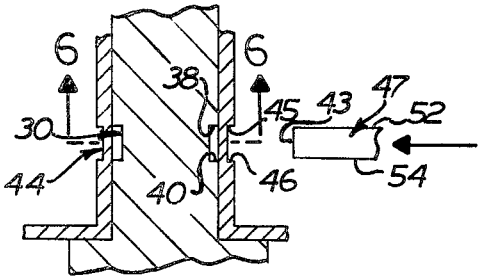
FIG.5
FIG.7
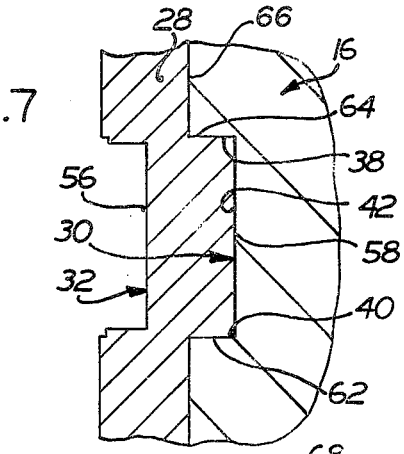
FIG.8
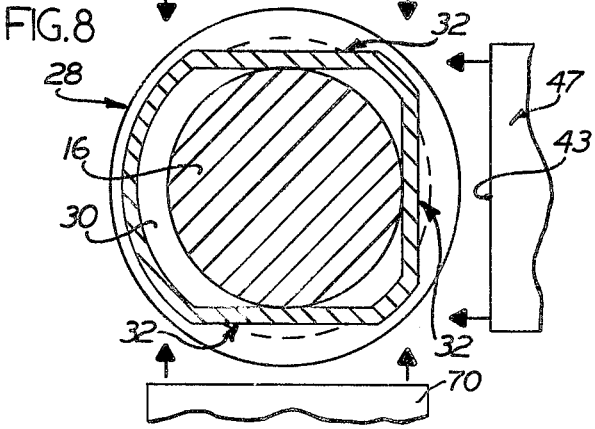
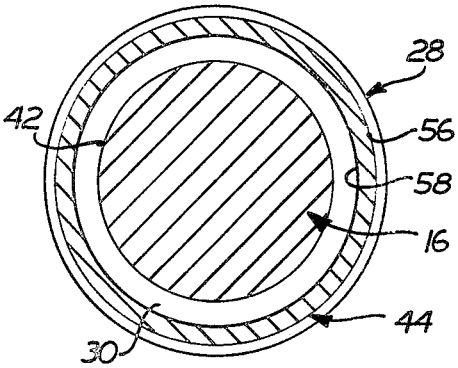
FIG.6

TUNING DEVICE

BACKGROUND OF THE INVENTION

This invention relates generally to a tuning device for a stringed musical instrument and to the method of assembling the tuning device.

There are many known devices of the worm and pinion type for varying the tension in the string of a musical instrument. Some of these devices are disclosed in U.S. Pat. Nos. 3,564,573 and 2,356,766. It is desirable to provide pinion shafts which are free of wobble and are constrained to pure rotary motion. This is because a string tuned with a wobbly pinion shaft does not produce a clear tone. The vibration of the string causes the shaft to move in the housing if it is not firmly supported; this causes the length of the string to vary slightly and thus produces a tone that is not clear. The distortion is especially noticeable when the instrument is played through an amplifier.

Any tuning device of the worm and pinion gear type must provide means for holding the pinion gear against axial motion. In some known devices the pinion gear is integrally formed with the shaft around which the string is wound. In these devices, the pinion and shaft are inserted in the housing until one side of the pinion gear abuts an annular bearing surface in the housing. The opposite surface of the pinion gear abuts a cap which is pressed into the housing after the pinion gear is in place. Thus the pinion gear is trapped against axial motion by two bearing surfaces. This method of holding the pinion gear against axial motion can fail when the cap becomes loosened in the housing.

In another approach to securing the pinion gear against axial motion, the pinion gear and the string shaft are separate pieces, held together by a machine screw. In this type of device a shoulder on the shaft abuts a bearing surface on the housing to prevent axial motion in one direction. The pinion gear abuts an annular bearing surface in the housing to prevent axial motion in the other direction. A disadvantage to this approach is eccentricity of assembly, accumulated manufacturing tolerances and that the pinion gear and shaft separate when the machine screw comes loose.

Additionally the desirability of eliminating backlash between the worm and pinion gear of tuning devices has been recognized. An extremely tight fit between the worm and pinion causes the gear to jam, and a loose fit causes excess play; both conditions are detrimental to sensitivity of tuning. There are known solutions to the problem of proper gear adjustment, one of which is disclosed in U.S. Pat. No. 4,014,239.

SUMMARY OF THE PRESENT INVENTION

The present invention provides a new and improved tuning device which is assembled by a new and improved method. The tuning device includes a pinion shaft supported by a large bearing surface area of a housing. The pinion shaft is held against axial motion by deforming one or more portions of the housing into an annular groove in the shaft.

In one preferred embodiment the housing surrounds the shaft with a smooth cylindrical surface which provides a large bearing area. This bearing area holds the shaft against sidewise movement to facilitate wobble-free rotation of the shaft. In addition the bearing area holds the shaft against sidewise movement, i.e. wobbling, during playing of the instrument.

The pinion shaft is held in a fixed axial position by indenting a portion of the housing into an annular groove in the shaft. The metal of the housing is pressed into the groove from a plurality of directions so that the shaft is held firmly against axial motion by the indentations and is free to rotate. Further, the indentations' circumferential positions on the housing serve to locate a pinion gear with respect to a worm in the tuning device. Thus it is possible to adjust the backlash between worm and pinion gear by selecting the direction of the force applied to indent the housing.

Accordingly it is an object of this invention to provide an improved method of making an improved tuning device which has a worm and a pinion gear for rotating a shaft connected with the string of an instrument and wherein the shaft is supported against both axial and sidewise movement by a housing.

It is a further object of this invention to provide a new and improved method and apparatus to hold the shaft of a tuning device for a stringed musical instrument against axial motion by indenting the walls of a housing to engage an annular groove in the shaft.

Another object of this invention is to provide a new and improved tuning device for a stringed musical instrument having a worm and pinion gear for rotating a shaft connected with the string of the instrument, and wherein the shaft is held against sidewise movement by a relatively large cylindrical surface area of a housing and is held against axial movement by at least one identation in the housing.

Another object of this invention is to provide a new and improved tuning device as set forth in the next preceding object and wherein the indentation in the housing projects into an annular groove in the shaft and is formed by plastically deforming the housing wall.

Another object of this invention is to provide a new and improved device for tuning a stringed musical instrument having a worm and a pinion gear connected with a shaft and having the shaft supported in a housing and able to rotate about a single axis, and wherein the pinion gear is held against axial motion and in proper meshing engagement with the worm by indentating the housing.

BRIEF DESCRIPTION OF THE DRAWINGS

The foregoing and other objects and features of the present invention will become more apparent upon a consideration of the following description taken in connection with the accompanying drawings wherein:

FIG. 3 is a sectional view of the tuning device of FIG. 2 illustrating the manner in which a shaft is connected with a pinion gear and a string of the instrument;

FIG. 4 is a sectional view of a portion of FIG. 3 and taken on an enlarged scale to further illustrate the relationship between a housing and the shaft and pinion gear;

FIG. 5 is a sectional view through the shaft and housing before indentations have been made by a punch;

FIG. 6 is a sectional view taken along line 6—6 of FIG. 5 further illustrating the shaft and housing prior to indenting;

FIG. 7 is an enlarged sectional view similar to that of FIG. 6 but taken after indenting; and FIG. 8 is an enlarged sectional view of the shaft and housing after indentation and showing the contact between the indented housing and an annular groove in the shaft.

Figure 1:
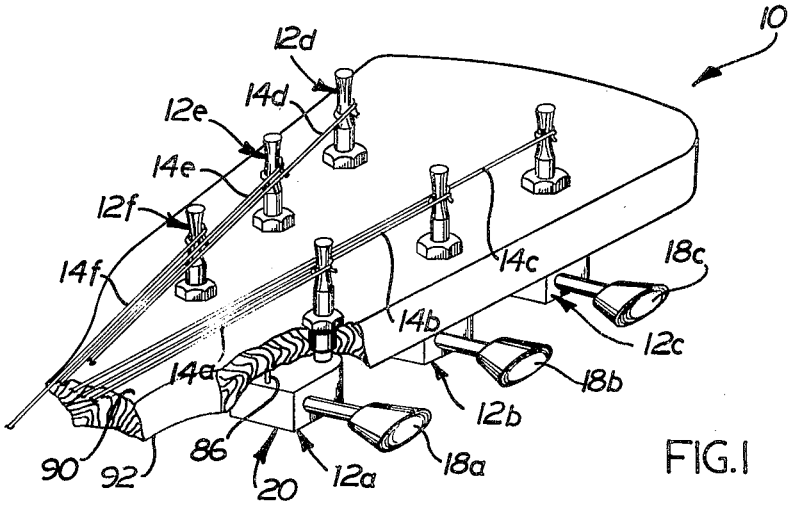
FIG. 1 is a fragmentary illustration of the head of a guitar having tuning devices constructed in accordance with the present invention.

The head portion 10 of a stringed musical instrument (not shown) includes improved tuning devices 12 *a-f* (FIG. 1). A plurality of strings 14 *a-f* extend from the body of the instrument (not shown) to the head 10, where each is attached to a metal shaft 16 of a tuning device 12. Each string 14 of the instrument may be tuned by rotating a knob 18 of the associated tuning device 12.

The tuning device 12 (FIG. 2) includes a metal housing 20 in which a worm 22 and pinion gear 24 (FIGS. 3 and 4) are disposed in meshing engagement with each other. The worm 22 is connected with an outwardly projecting actuator shaft 26 (FIG. 2) which is fixedly connected with the knob 18. The worm 22 (FIG. 3) is rotatably supported in the housing 20 by annular bearing surfaces (not shown) in the housing. The housing 20 has a cylindrical tubular section 28 which supports the shaft 16. One end portion of a string 14 is wound around the shaft 16. When the knob 18 is turned, a helical convolution of the worm 22 causes the pinion gear 24 to rotate the shaft 16 about its central axis. Rotation of the shaft 16 varies the tension in the string 14 to vary the pitch of the string in a well known manner.

In accordance with one of the features of the present invention the cylindrical shaft 16 is held against axial movement relative to the housing by a unique retainer arrangement 29 (FIGS. 3 and 4). The tubular section 28 of the housing 20 has a plurality of projections 32 (FIGS. 4 and 8) which extend into the groove 30 in the shaft 16. The projections 32 engage the groove 30 to hold the shaft 16 against axial movement relative to the housing 20. The projections 32 are also effective to hold the shaft 16 against sidewise movement relative to the housing 20.

The annular groove 30 (FIG. 4) is coaxial with the cylindrical shaft 16 and is located between opposite end portions of the shaft. One end portion 34 of the shaft 16 is connected with a string 14 of the instrument. The other end portion 36 of the shaft 16 is fixedly connected with the pinion gear 24. The pinion gear 24 is disposed on the end of the shaft 16 in a coaxial relationship with the shaft. The annular groove 30 has circular side walls 38 and 40 which extend perpendicular to the central axis of the shaft 16. A cylindrical bottom surface 42 of the groove 30 is parallel to the outside surface of the shaft 16.

To facilitate formation of the projections 32, the tubular section 28 of the housing 20 is provided with an annular groove 44 (FIGS. 5 and 6). The groove 44 provides an area of reduced cross section in the cylindrical tubular section 28. When a punch 47 is pressed against the groove 44 in the tubular section 28 of the housing, the relatively thin wall of the reduced section portion deforms easily. Therefore the punching process does not significantly deform any other portion of the housing 20.

In accordance with another feature of the present invention the tuning device 12 is readily assembled with the shaft 16 and gear 24 accurately located in the housing. In assembling the tuning device, the shaft 16 is inserted into the housing 20 until the annular groove 30 is aligned with the housing groove 44 (FIG. 5). The shaft 16 is provided with a cylindrical shoulder or flange 48 having an annular bearing surface area 49 which abuts an annular bearing surface area 50 formed on the inside of the housing 20. Thus the two bearing surfaces 49 and 50 function to radially align the two grooves 30 and 44 during assembly of the tuning device 12. In addition the bearing surfaces 49 and 50 subsequently function to rotatably support the gear 24 in the housing 20.

Once the groove 30 in the shaft 16 is in alignment with the groove 44 in the housing 20, the punch 47 is pressed against the housing to plastically deform the housing wall into engagement with the sides 38 and 40 and bottom 42 surfaces of the shaft groove 30 (FIGS. 7 and 8). The punch 47 is dimensioned to assure close abutting engagement between the projection 32 and the sides 38 and 40 and bottom 42 surfaces of the shaft groove 30 (FIG. 7). In a preferred embodiment the punch face 43 (FIG. 5) is 0.080 inches wide while the distance between the radial side surfaces 38 and 40 of the groove 30 in the shaft 16 is 0.090 inches, and the distance between the radial side surfaces 45 and 46 of the groove 44 in the tubular portion 28 of the housing 20 is also 0.090 inches. The tubular portion 28 has an outside diameter of 0.375 inches and a shaft 16 has a diameter of 0.250 inches, the thickness of the tubular portion 30 is 0.062 before groove 44 is formed. This groove is cut 0.010 inches deep, leaving a reduced thickness portion 44 0.052 inches thick which is to be pressed into a groove 30 that is 0.025 inches deep.

When the punch 47 is properly aligned, there is 0.005 inches clearance on each side between the top 52 and bottom 54 of the punch and the radial side surfaces 45 and 46. This assures that the surfaces 38 and 40 in the groove 30 will act as a die during the punching operation and shear the metal of the groove 44 in the housing 20. Thus the punch 47 moves the material of the housing 20 as a single unit by shearing at the edges until there is firm uniform contact with the bottom 42 of the groove 30 and the side surfaces 38 and 40 of the groove.

Although the dimensions in the preferred embodiment are disclosed above, it is also contemplated that other dimensions could be used. Thus, for example, the leading end surface 43 (FIG. 5) of the punch 46 could have a width which is less than the distance between the radial side surfaces 38 and 40 of the groove 30 and the radial side surfaces 45 and 46 of the groove 44. This enables the reduced thickness portion 44 of the tubular portion 28 to be plastically deformed into the groove 30 in the shaft 16. In this embodiment the width of the punch 47 is approximately equal to the width of the groove 30 minus twice the thickness of the reduced area section of the housing. The punch face 43 is 0.060 inches wide and the reduce thickness portion 44 is 0.052 inches thick. The groove is made 0.160 inches to assure that the punch 47 is able to deform the walls of the tubular section 28 into firm contact with the bottom 42 of the groove 30 and the side surfaces 38 and 40 of the groove 30.

The punching or indenting operation assures that the shaft 16 is held firmly against both axial and sidewise movement. After punching, the reduced area section 44 (FIG. 5) of the tubular portion 28 is deformed to conform to the shape of the groove 30 in the shaft 16 (FIG. 7). The center portion 58 of the deformation is in abutting engagement with the bottom 42 of the groove 30 in the shaft. This prevents wobbling or sidewise motion of the shaft 16 relative to the tubular portion 28. The side portions 62 and 64 of the deformation 32 are in abutting engagement with at least a portion of the radially extending side walls 38 and 40 of the groove 30 in the shaft 16. The contact between the upper side portion 64 and the upper radially extending side wall 38 prevents axial motion of the shaft 16 with respect to the housing 20 in an upward direction (as viewed in FIGS. 3 and 7). The contact between the lower side portion 62 of the deformation 32 and the lower side wall 40 prevents axial motion of the shaft 16 with respect to the housing 20 in a downward direction.

After the punching operation has been performed, the side portions 62 and 64 of the deformation extend substantially parallel to the sides 38 and 40 of the groove 30 in the shaft. The large surface area of the deformation firmly abuts the walls 38 and 40 of the groove, thus distributing the axial loads on the shaft 16 to the housing 20 through a large surface area of contact. This reduces wear on the side surfaces 62 and 64 of the deformation and on the side walls 38 and 40 of the groove. Additionally, the contact between the side surfaces 62 and 64 and the side walls 38 and 40 holds the two bearing surfaces 48 and 50 in close abutting engagement.

It is important in the construction of a tuning device of the worm and pinion type that the backlash or play between the gears be correct. Gears that are too tightly pressed together bind and do not operate smoothly, while too loose a fit results in loss of precise control of the tuning device. Some variation or manufacturing tolerance of the sizes of the gears 22 and 24 (FIGS. 3 and 4) and of the shaft 16 and tubular portion 28 are necessary to keep the cost of the finished product as low as possible. These variations mean that some gears 22 and 24 will fit too loosely and some shafts 16 will not be supported snugly against sidewise movement by the inside walls 66 of the tubular portion 28. The punching process provides a technique for compensating for manufacturing variations.

In a preferred embodiment of the present invention the backlash between the worm 22 and pinion gear 24 is zero. That is, the gears are neither so tight that they bind, nor loose enough to have any detectable play between them. Using the method of this invention the desired backlash can be easily obtained by indenting the reduced area portion 44 of the tubular portion 28 of the housing 20 from a direction opposite the worm 22 with the punch 47. This forces the pinion gear 24 into close engagement with the worm 22 by forcing the shaft 16 against the portion of the wall of the tubular portion 28 closest to the worm 22.

To use this method of achieving zero backlash, the shaft 16 is inserted into the housing 20 until the annular groove 30 on the shaft 16 is aligned with the reduced area portion 44 of the tubular portion (FIGS. 5 and 6). At this point the bearing surface 49 on the pinion gear 24 is in abutting engagement with the bearing surface 50 on the housing 20. A single punch 47 then indents the housing 20 from a direction opposite the worm 22, thus deforming the housing 20 into engagement with the sides 62 and 64 and bottom 42 of the groove (FIGS. 7 and 8). This punching process takes up any play due to the differences in diameters of the inside of the tubular portion 28 and the shaft 16 by pushing the shaft 16 in the direction of the worm 22. Pushing the shaft 16 in this direction guarantees that there will be no backlash between the worm 22 and pinion gear 24.

The shaft 16 of a tuning device 12 with a single indentation 32 may still be able to wobble or move sidewise. By the use of two more punches 68 and 70 (FIG. 8) in a direction perpendicular to the direction of the first punch 46, the housing 20 is indented two more times and holds the shaft more firmly than before against sidewise motion. These additional punches 68 and 70 have the same proportions as the first punch 47.

The shaft 16 (FIG. 3) is further supported against sidewise motion by the walls 66 of the tubular portion 28 of the housing 20. The tubular portion 28 has two smooth cylindrical bearing surfaces 72 and 74 on opposite sides of the reduced area portion 44 which cooperate with the corresponding bearing surfaces 76 and 78 on the shaft 16. These bearing surfaces 72, 74, 76, and 78 provide bearing areas that are long compared to the diameter of the shaft 16 and thus are effective to support the shaft against sidewise motion.

When a stringed musical instrument is equipped with a tuning device having a wobbly shaft and it is played through an amplifier, the tone produced is fuzzy and not clear. The combination of the indenting or pressing of the housing 20 and the large bearing surfaces 72, 74, 76 and 78 eliminates virtually all wobble from the shaft 16. An instrument equipped with tuning device 12 made according to the present invention produces a clear tone, even under amplification.

It is further contemplated by the present invention that a swaging process could be used instead of the punches 46, 68 and 70 to form a uniform indentation of the reduced area portion 44 of the tubular portion 28. The indentation produced by swaging would be uniform in all radial directions and would eliminate any play caused by manufacturing tolerances.

Although one preferred embodiment includes a shaft 16 integrally formed with the pinion gear 24 (FIGS. 3 and 4), it is also contemplated that they could be separate. The gear 24 and the shaft 16 could be assembled and held together with a machine screw or similar device. In this case the gear 24 could be made without including the bearing surface 48, and the bearing surface 48 could be integrally formed with the shaft 16 as a flange or shoulder. Or the bearing surface 48 could be attached to and integrally formed with the gear 24. In either case once the shaft 16 and gear 24 are assembled, they are inserted and held in the housing 20 in the above-described manner.

When the device has been punched or swaged and the retainer arrangement is complete, a cap 79 is installed to keep dirt out and to provide a neat appearance. The cap may also include a circular bearing surface (not shown) which abuts the bottom 80 (as viewed in FIGS. 3 and 4) of the pinion gear 24 to further hold it against axial motion. The cap may be mounted in any desired way in an opening 82 in the housing 20.

Figure 2:
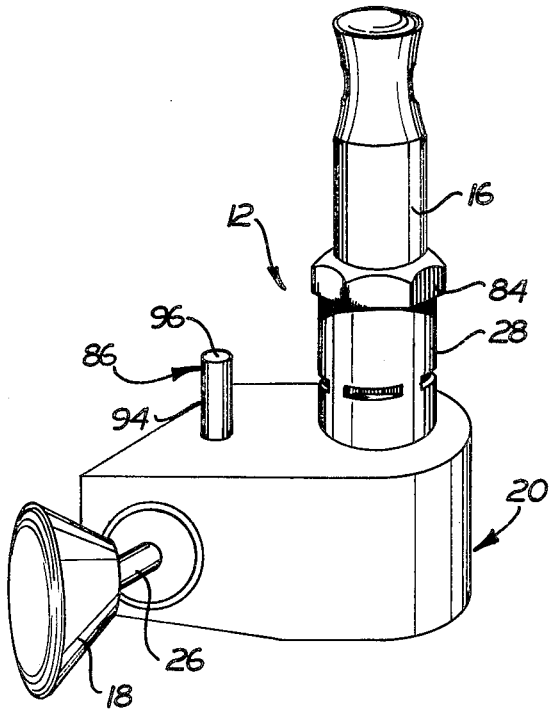
FIG. 2 is an enlarged pictoral illustration of a tuning device shown in FIG. 1.

A device made in accordance with the present invention is held to the instrument by a nut 84 and a pin 86 (FIGS. 1, 2 and 3). The nut 84 cooperates with threads 88 on the tubular portion 28 and serves to clamp the device 12 to the instrument by abutting the top surface 90 of the head portion 10 of the instrument while the housing 20 abuts the bottom surface 92. A pin 86 (FIGS. 2 and 4) having a smooth cylindrical outside surface 94 and two circular end surfaces 96 and 98 is received in a closed cylindrical recess 100 in the top of the housing 20. The pin 86 extends into a cylindrical passage in the bottom of the head 10 of the instrument. The nut 84 and tubular portion 28 cooperate to secure the tuning device 12 to the head 10 of the instrument. The tubular portion 28 and the pin 96 cooperate to keep the device 12 from rotating with respect to the instrument.

In view of the above disclosure it is clear that the present invention provides a new and improved tuning device 12 which is assembled by a new and improved method (FIG. 3). The tuning device 12 includes a pinion shaft 16 supported by a large bearing surface area 66 of a housing 20. The pinion shaft 16 is held against axial motion by deforming one or more portions 32 of the housing into an annular groove 30 in the shaft.

In one preferred embodiment the housing surrounds the shaft 16 with a smooth cylindrical surface 66 which provides a large bearing area. This bearing area 66 holds the shaft 16 against sidewise movement to facilitate wobble-free rotation of the shaft. In addition the bearing area 66 holds the shaft against sidewise movement, i.e. wobbling, during playing of the instrument.

The pinion shaft 16 is held in a fixed axial position by indenting a portion of the housing 20 into an annular groove in the shaft (FIGS. 3 and 4). The metal of the housing 20 is pressed into the groove 30 from a plurality of directions (FIG. 8) so that the shaft 16 is held firmly against axial and sidewise motion by the indentations 32 and is free to rotate.

The indentations' 32 at circumferential positions on the housing 20 serve to locate the pinion gear 24 with respect to the worm 22. Thus the play or backlash between the worm 22 and pinion gear 24 can be adjusted by indenting the housing 20 from a direction opposite the worm 22 to force the pinion gear 24 into proper engagement with the worm.

Although the retainer arrangement 29 has been disclosed herein in association with a guitar string tuning device having a housing of a particular shape, it is contemplated that the invention could be practiced in association with many different types of housings and stringed instruments. Although three indentations 32 have been shown in FIG. 8, it is contemplated that either a larger or smaller number of indentations could be utilized if desired.

Having described specific preferred embodiments of the invention the following is claimed:

1. A method of assembling a stringed instrument tuning device, said method comprising the steps of providing a housing having a main portion adapted to at least partially enclose a gear and a tubular portion integrally formed with and extending outwardly from the main portion, providing a shaft having an annular groove disposed intermediate opposite ends of the shaft, positioning the shaft in the tubular portion of the housing, and plastically deforming the tubular portion of the housing inwardly into engagement with the shaft to hold the shaft against axial movement relative to the housing, said step of plastically deforming the tubular portion of the housing including the steps of applying a force against an outer side surface of the tubular portion of the housing at a location radially outwardly from the annular groove and moving a portion of the housing into the annular groove in the shaft under the influence of the force applied against the outer side surface of the tubular portion of the housing.

2. A method as set forth in claim 1 wherein said step of providing a housing having a main portion and a tubular portion includes the step of providing a housing having a tubular portion with a first wall thickness and a section with a second wall thickness which is less than the first wall thickness, said step of applying a force against an outer side surface of the tubular portion of the housing including the step of applying a force against the section of the tubular portion having the second wall thickness.

3. A method as set forth in claim 1 wherein said step of providing a shaft includes the step of providing a shaft having a gear connected with one end portion of the shaft, said step of positioning the shaft in the housing includes the step of positioning the gear in the main portion of the housing.

4. A method of assembling a stringed instrument tuning device which includes a shaft adapted to be connected with a string of the musical instrument, a housing adapted to at least partially enclose the shaft, a worm, and a pinion gear connected with the shaft and disposed in meshing engagement with the worm, the shaft having an annular groove intermediate its ends, said method comprising the steps of inserting at least a portion of the shaft into the housing; and retaining the shaft against axial movement relative to the housing, said step of retaining the shaft against axial movement including the step of deforming a wall of the housing inwardly into engagement with the shaft after performing said step of inserting the shaft into the housing, said step of deforming a wall of the housing includes the step of pressing the wall of the housing on a side of the shaft opposite from the worm into engagement with the annular groove.

5. The method as set forth in claim 4 wherein the housing has a tubular portion for receiving the shaft, said method further including the step of cutting an annular groove in said tubular portion of the housing to form a section of reduced cross sectional area, and wherein said step of deforming the wall includes deforming the reduced area section.

6. A method as set forth in claim 4 wherein said step of pressing a portion of the wall of the housing into engagement with the annular groove in the shaft includes the step of simultaneously pressing against opposite sides of the housing to press opposite sides of the housing into the annular groove.

7. A device for tuning a stringed musical instrument comprising a rotatable shaft, gear means for rotating said shaft, said gear means including worm and pinion gears disposed in meshing engagement with each other, a housing which at least partially encloses said shaft, said shaft having a first end portion adapted to be connected with a string of the instrument and a second end portion connected with said gear means, said pinion gear being connected with said second end portion of said shaft, said shaft further having surface means for defining a circumferential groove intermediate said end portions, said housing having retaining means for engaging said groove in said shaft to prevent axial movement of said shaft relative to said housing and for applying a force to said shaft to press said pinion gear against said worm gear.

8. A device as set forth in claim 7 wherein said retaining means includes a plurality of indentations formed in said housing, each of said indentations extending into said groove to hold said shaft against axial movement relative to said housing.

9. A device as set forth in claim 7 further including pin means for securing said housing against rotation relative to the instrument, said pin means including a first end portion which is received in a closed recess in said housing and a second end portion which engages the musical instrument, said pin means further including a smooth side surface area which is received in a hole in the musical instrument.

10. A method of making a tuning device for a stringed musical instrument wherein the device includes a worm and pinion gear and wherein the pinion gear is connected with a shaft, said method comprising the steps of providing a housing having a first bearing surface associated therewith, providing a shaft fixedly connected with the pinion gear which has a second annular bearing surface associated therewith, forming an annular groove in the shaft at a location intermediate its ends positioning the second bearing surface in abutting engagement with the first bearing surface, and gripping the shaft with the housing at a location intermediate the ends of the shaft to hold the first and second bearing surfaces in engagement, said step of gripping the shaft including the step of plastically deforming a wall of the housing by pressing against the wall of the housing on the side opposite the worm to force the pinion gear into engagement with the worm.

11. A method of assembling a stringed instrument tuning device having a generally cylindrical shaft which is adapted to be connected with a string of the instrument at one end and with a pinion gear at the other end, the shaft having an annular groove intermediate its ends, the device further including a rigid metal housing adapted to enclose the pinion gear and to at least partially enclose the shaft in a tubular portion of the housing, said method comprising the steps of inserting at least a portion of the shaft into the tubular portion of the housing, inserting the pinion gear into the housing, and thereafter retaining the pinion gear and shaft against axial movement relative to the housing by plastically deforming the tubular portion of the housing inwardly into engagement with the annular groove in the shaft.

12. A device for tuning a stringed musical instrument comprising a rotatable cylindrical shaft, gear means for rotating said shaft, said gear means including worm and pinion gears disposed in meshing engagement with each other, housing means for retaining said shaft and said gear means in a predetermined relationship to one another, said shaft having a first end portion adapted to be connected with a string of the instrument and a second end portion connected with said gear means, said pinion gear being connected with said second end portion of said shaft, said shaft further having surface means for defining an annular groove, said housing having a wall extending axially along said shaft, said wall having a cylindrical inner surface area disposed in abutting engagement with the cylindrical outer side surface area of said shaft to hold said shaft against sidewise movement, said wall having a portion extending radially inwardly from said cylindrical surface of said wall into abutting engagement with said surface means to hold said shaft against axial movement relative to said housing means, said radially inwardly extending portion of said wall being effective to apply a force against the side portion of said shaft to urge said pinion gear into engagement with said worm.

13. A device as set forth in claim 12 wherein said radially inwardly extending portion of said wall is located between axially opposed end portions of said wall, said cylindrical inner surface area of said wall being disposed in engagement with said shaft on axially opposite sides of said annular groove.

14. A device disposed on the head of a stringed musical instrument for tuning the instrument, said device comprising a rigid housing, a shaft having a first end portion adapted to be connected with a string of the instrument and a second end portion disposed in said housing, a worm and pinion gear disposed in meshing engagement with each other, said second end portion of said shaft being fixedly connected with said pinion gear, said shaft having an annular groove intermediate said first and second end portions, said rigid housing including a rigid bottom wall adapted to abuttingly engage the head of the instrument and a rigid tubular wall integrally formed with said bottom wall and adapted to extend at least part way through the head of the instrument, said tubular wall extending around an axially extending portion of said shaft on axially opposite sides of said annular groove and having surface means projecting radially inward into said annular groove in said shaft for holding said shaft against axial movement relative to said housing, said radially inwardly projecting surface means including means for applying a force against a portion of said shaft to urge said pinion gear into engagement with said worm.

15. A device as set forth in claim 14 wherein said radially inwardly projecting surface means includes first and second surfaces projecting radially inwardly into said annular groove in said shaft from diametrically opposed locations on said tubular wall.

16. A device as set forth in claim 15 wherein said radially inwardly projecting surface means includes a third surface projecting radially inwardly into said annular groove from a location on said tubular wall intermediate said first and second surfaces.

17. A device as set forth in claim 14 wherein said tubular wall has a first thickness on opposite sides of said groove and has a second thickness which is less than said first thickness at the portion of said tubular wall where said surface means projects into said annular groove.

18. A method of assembling a stringed instrument tuning device which includes a shaft adapted to be connected with a string of the musical instrument and a housing adapted to at least partially enclose the shaft, said method comprising the steps of inserting at least a portion of the shaft into the housing; and retaining the shaft against axial movement relative to the housing, said step of retaining the shaft against axial movement including the step of deforming a wall of the housing inwardly into engagement with the shaft after performing said step of inserting the shaft into the

19. The method as set forth in claim 18 wherein the housing has a tubular portion for receiving the shaft, said method further including the step of cutting an annular groove in tubular portion of the housing to form a section of reduced cross sectional area, and wherein said step of deforming the wall includes deforming the reduced area section.

20. A method as set forth in claim 18 further including the step of forming an annular groove in the shaft intermediate the ends of the shaft and wherein said step of deforming the wall of the housing includes the step of pressing a portion of a wall of the housing into engagement with the annular groove in the shaft.

21. A method as set forth in claim 20 wherein said step of pressing a portion of the wall of the housing into engagement with the annular groove in the shaft includes the step of simultaneously pressing against opposite sides of the housing to press opposite sides of the housing into the annular groove.

22. A device disposed on the head of a stringed musical instrument for tuning the instrument, said device comprising a rigid housing, a shaft having a first end portion adapted to be connected with a string of the instrument and a second end portion disposed in said housing, a worm and pinion gear disposed in meshing engagement with each other, said second end portion of said shaft being fixedly connected with said pinion gear, said shaft having an annular groove intermediate said first and second end portions, said rigid housing including a rigid bottom wall adapted to abuttingly engage the head of the instrument and a rigid tubular wall integrally formed with said bottom wall and adapted to extend at least part way through the head of the instrument, said tubular wall extending around an axially extending portion of said shaft on axially opposite sides of said annular groove and having surface means projecting radially inward into said annular groove in said shaft for holding said shaft against axial movement relative to said housing, said radially inwardly projecting surface means further including first and second surfaces projecting radially inwardly into said annular groove in said shaft from diametrically opposed locations on said tubular wall, further including a third surface projecting radially inwardly into said annular groove from a location on said tubular wall intermediate said first and second surfaces, said third surface being effective to apply a force against a portion of said shaft to urge said pinion gear into engagement with said worm.

23. A method of assembling a stringed instrument tuning device and for adjusting the backlash between a worm and pinion gear in which the device includes a generally cylindrical shaft which is adapted to be attached with a string of the instrument at one end and to be connected with the pinion gear at the other, the device further including a housing adapted to at least partially enclose the shaft in a tubular portion of the housing, said method comprising the steps of inserting at least a portion of the shaft into the housing, retaining the pinion gear in meshing engagement with the worm and against axial movement relative to the housing by plastically deforming a wall of the housing inwardly into engagment with the shaft in a plurality of radial directions, detecting the presence of excessive backlash between the pinion and worm gears, correcting excessive backlash by deforming the wall of the housing in a direction calculated to establish a desired backlash between worm and pinion gears.

24. A method of making a tuning device for a stringed musical instrument, said method comprising the steps of providing a housing having a first bearing surface associated therewith, providing a shaft fixedly connected with a gear which has a second bearing surface associated therewith, forming an annular groove in the shaft at a location intermediate its ends, positioning the second bearing surface in abutting engagement with the first bearing surface, and gripping the shaft with the housing at said location intermediate the ends of the shaft to hold the first and second bearing surfaces in abutting engagement, said step of gripping the shaft includes the step of pressing a wall of the housing into engagement with the annular groove.

25. A method of making a tuning device for a stringed musical instrument, said method comprising the steps of providing a housing having a first bearing surface associated therewith, providing a shaft fixedly connected with a gear which has a second bearing surface associated therewith, positioning the second bearing surface in abutting engagement with the first bearing surface, and gripping the shaft with the housing at a location intermediate the ends of the shaft to hold the first and second bearing surfaces in abutting engagement, said step of gripping the shaft with the housing includes plastically deforming a wall of the housing into engagement with the shaft.

* * * * *

UNITED STATES PATENT AND TRADEMARK OFFICE

CERTIFICATE OF CORRECTION

PATENT NO. : 4,353,280

DATED : October 12, 1982

INVENTOR(S) : Robert J. Spercel

It is certified that error appears in the above-identified patent and that said Letters Patent are hereby corrected as shown below:

Column 10, line 48, after "the",second occurrence, insert --housing.--.

Signed and Sealed this

*Eighth* Day of *March 1983*

[SEAL]

*Attest:*

GERALD J. MOSSINGHOFF

*Attesting Officer*

*Commissioner of Patents and Trademarks*